United States Patent [19]

Corzine

[11] Patent Number: 4,993,757

[45] Date of Patent: Feb. 19, 1991

[54] ELECTROMECHANICAL LOCKING DEVICE

[76] Inventor: Robert D. Corzine, 710 5th St., Esther, Mo. 63601

[21] Appl. No.: 407,277

[22] Filed: Oct. 13, 1989

[51] Int. Cl.[5] ..... E05B 55/00; E05C 1/08

[52] U.S. Cl. ..... 292/144; 292/341.16

[58] Field of Search ..... 292/144, 341.16, 335; 70/151 R

[56] References Cited

U.S. PATENT DOCUMENTS

| | | | |
|---|---|---|---|
| 1,768,021 | 6/1930 | Bauerband . | |
| 2,390,731 | 12/1945 | Oxhandler | 70/118 X |
| 2,798,751 | 11/1957 | Walden . | |
| 3,353,383 | 11/1967 | Fish | 70/151 R |
| 3,621,686 | 11/1971 | Klein | 292/335 X |
| 3,919,869 | 11/1975 | Fromm | 292/341.16 X |
| 4,099,752 | 7/1978 | Geringer | 292/144 |
| 4,262,504 | 4/1981 | Inoue | 292/144 |
| 4,824,151 | 4/1989 | Taylor | 292/341.16 X |

FOREIGN PATENT DOCUMENTS

| | | | |
|---|---|---|---|
| 27559 | 9/1906 | Fed. Rep. of Germany | 292/341.16 |
| 1016219 | 11/1952 | France | 292/335 |

OTHER PUBLICATIONS

Lock Assembly No. 122-126E-EM, Folger Adam Company, one page, Drawing #231-1200-001.

*Primary Examiner*—Eric K. Nicholson

*Attorney, Agent, or Firm*—Haverstock, Garrett & Roberts

[57] ABSTRACT

This invention discloses an electromechanical bolt assembly for locking a door. A bolt, which is retracted when a solenoid is energized, moves a lever assembly which causes a latch trigger to extend into the doorway. The bolt is held in the retracted position by a detente while the door remains open. When the door is closed, it depresses the latch trigger, which operates the lever assembly, causing the bolt to disengage from the detente and extend into the locked position. This locking mechanism is well suited to high-security environments such as prisons. It is highly durable, and can be contained in a housing which allows for simple and convenient installation.

23 Claims, 3 Drawing Sheets

ELECTROMECHANICAL LOCKING DEVICE

FIELD OF THE INVENTION

This invention pertains to electrically-actuated devices which can be used to lock doors, especially in high security locations such as prisons and military installations.

BACKGROUND OF THE INVENTION

Various types of electrically-actuated mechanisms have been developed for extending and retracting locking devices such as deadbolts. Such devices allow a deadbolt on a door or a similar moving device to be retracted by an operator such as a security guard at a remote and protected location.

For example, U.S. Pat. No. 1,768,021 (Bauerband 1930) discloses a deadbolt which is mounted on the end of a door and which protrudes outwardly. Rather than a swinging door mounted on hinges, the door is a sliding door mounted on rollers, so that when it is pushed against the closure frame, the bolt will be inserted by the door movement into the opening of the latching device. In the process, the tip of the bolt pushes back a spring-mounted detente, which normally holds back a movable pin in a solenoid. When the detente is pushed out of the way by the bolt, the pin is released; it drops and passes through a slot in the bolt, thereby locking the door in its closed position. The door is unlocked by energizing the solenoid, which raises the pin. The door must be opened while the solenoid remains energized. After the door is opened, the spring-loaded detente keeps the pin lifted out of the path of the bolt, so the door can be closed later without operating the solenoid.

U.S. Pat. No. 2,798,751 (Walden 1957) also discloses a lock device operated by a solenoid. The solenoid, when energized, lifts a vertically mounted solenoid pin. The pin is connected to one rotating lever, which in turn is coupled to a second rotating lever, which in turn is coupled to a swinging lever which can swing in either of two directions, depending on whether the deadbolt was open or closed when the solenoid was energized. The swinging lever is coupled to the deadbolt via an indirect linkage involving two more moving pieces, so that when the lever swings in either direction, the deadbolt either retracts (to unlock the door) or extends (to lock it again). The deadbolt is retracted by operating the solenoid, and it remains retracted so the door can be opened or closed any number of times, until the solenoid is operated again.

Despite their advantages, the locking devices of the prior art suffer from various limitations. For example, the locking device of Bauerband must be located on a sliding door rather than a hinged door, and the outward protrusion of the exposed deadbolt can lead to problems such as bending and tampering. The device of Walden requires at least nine different moving parts, not including the various hinge screws, and if a single one of those parts or hinges becomes jammed, frozen, corroded, or gummed, the entire locking device can be rendered totally inoperative. In addition, that multiplicity of parts makes the device expensive to manufacture and assemble, and difficult to repair. Furthermore, since the swinging lever of the Walden device requires unconstrained motion without generating a large amount of momentum, the use of grease to lubricate and protect the internal parts can generate problems.

One of the most crucial need for locks used by prisons is durability. A single locked door in a prison is often locked and unlocked several hundred times each day. Under those conditions, they can become so worn within six months that they can no longer be repaired by a professional locksmith and must be replaced.

One object of the present invention, therefore, is to provide a durable, heavy-duty lock which can offer extended, reliable performance despite heavy use.

Another object of this invention is to provide a locking mechanism with a minimal number of moving parts, any of which can be replaced easily to prolong the useful life of the assembly.

Another object of the present invention is to provide a relatively simple and inexpensive but reliable locking mechanism which can be opened by a remote operator.

Another object of this invention is to provide a solenoid-operated door bolt which, once retracted remains retracted until the door is closed.

Another object is to teach the construction and operation of a locking device which goes automatically into a locked condition when the door on which it is installed closes, without requiring further operation of the solenoid.

Another object of this invention is to provide a locking system especially adapted for use in locations which require a high level of security, such as prisons and military bases.

Another object is to provide a locking device which is difficult for unauthorized persons to unlock or tamper with.

Another object is to provide a locking device that is relatively compact and is relatively easy to install without requiring extensive adjustment.

Another object is to provide a locking device which is aided by gravity and by mechanical force to move to a latched condition when the door on which it is installed is closed.

SUMMARY OF THE INVENTION

This invention resides in an electromechanical solenoid-operated locking device. The device includes a bolt assembly, usually mounted in a wall adjacent to a door jamb, and includes a bolt that extends into the door jamb and into cooperating engagement with a bolt-receiving member or keeper located on the door. The bolt in the present construction is preferably mounted at an angle to the horizontal such that gravity will tend to move the bolt toward its extended or locked position. The bolt is also connected to the armature of a solenoid so that when the solenoid is energized, the bolt will be moved toward its retracted or unlocked position.

The bolt has two spaced notches or indentations formed in one side thereof. These notches or indentations cooperate with a spring-biased detent located adjacent to one side of the bolt. The detent will engage one indentation in the locked position and the other indentation in the unlocked position. It is therefore not necessary to maintain the solenoid in an energized condition once the bolt has moved to its retracted or locked position.

The present device also includes a pivotal lever arm assembly mounted in the device. The lever arm assembly has a first portion which engages with the bolt, a pivotal mount, and a second portion comprising a latch trigger which can extend into the door jamb.

When the door is unlocked and opened, the first portion of the lever arm will be moved by the retraction of the bolt. The rotation of the lever arm will cause the latch trigger to be moved into its extended position, protruding into the door jamb. When the door is closed, it will depress the extended latch trigger. This will cause the lever arm to press against the rear end of the bolt, moving the bolt sufficiently far so that the spring-biased detent will be dislodged from the indentation. The bolt will continue moving to its locked or bolted condition by action of gravity, preferably aided by spring means in the solenoid.

The present construction therefore allows a guard or other authorized person to unlock the door from a remote location by energizing the solenoid and retracting the bolt. While the door remains open, the bolt will be held in its retracted position. As soon as the door is closed, the bolt will be extended into its locked position without requiring any further effort by the guard or by the person passing through the door. If a person passing through the door should intentionally or otherwise press against the extended latch trigger to release the bolt prematurally, the guard can simply reenergize the solenoid to retract the bolt again and no harm will be done.

DETAILED DESCRIPTION OF THE PREFERRED EMBODIMENTS

Figure 1:
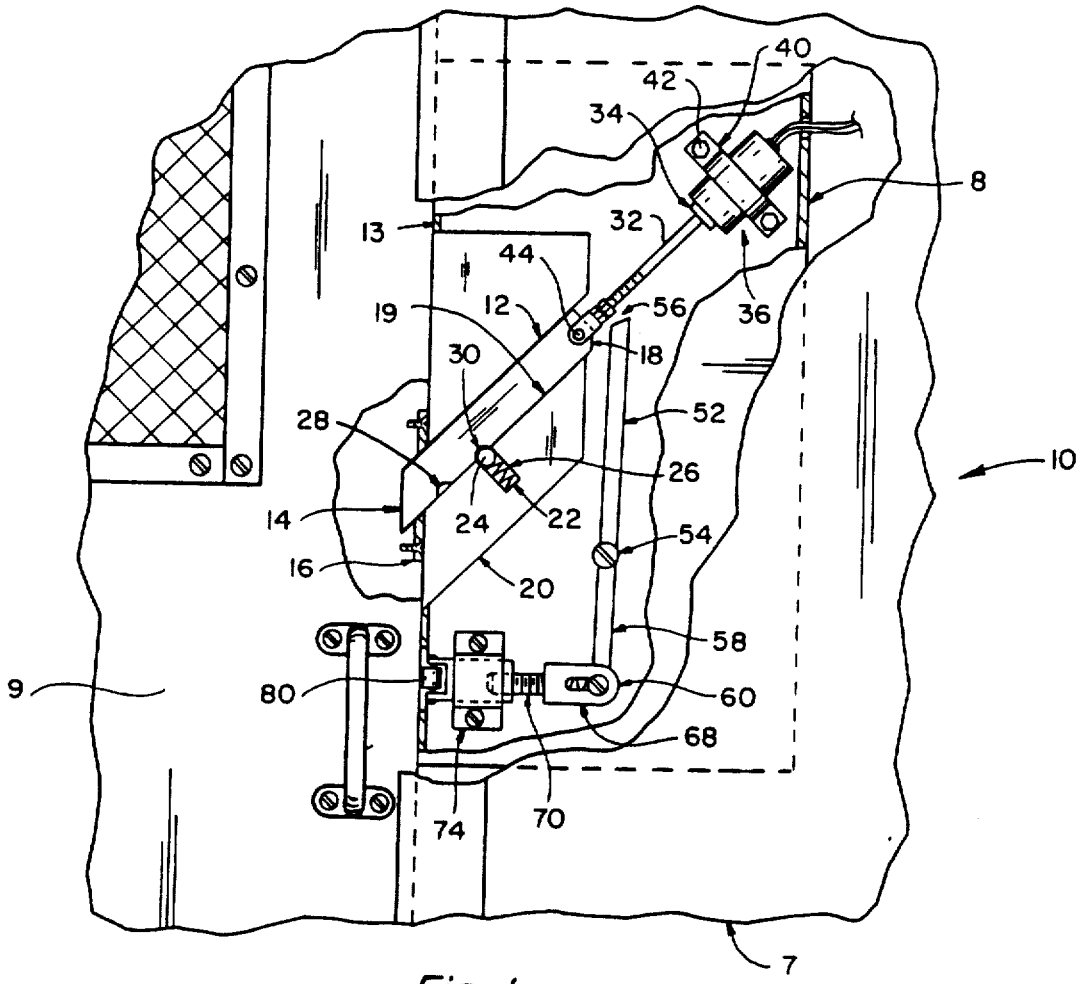
FIG. 1 is a fragmentary side-elevational view of a door assembly equipped with a locking device constructed according to the present invention, the bolt shown in its extended or locked position.
Figure 2:
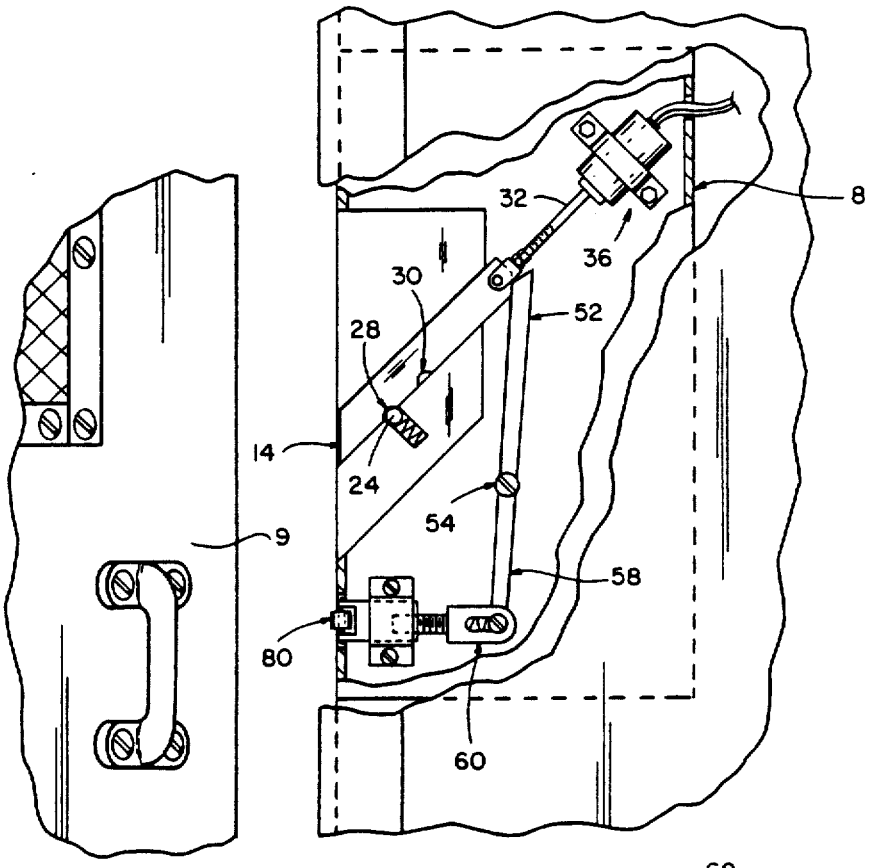
FIG. 2 is a fragmentary side-elevational view of the same locking device, shown with the bolt in its retracted or unlocked position.

Referring to the drawings more particularly by reference numbers, number 10 in FIGS. 1 and 2 refers to a door locking assembly constructed according to the present invention. The locking assembly is shown in FIG. 1 with bolt 12 in its extended or door-locking position. In this preferred embodiment, the assembly 10 is shown installed on or in the wall 7 adjacent to one side of a door opening or jamb. The assembly can be mounted in a housing 8 for convenience in installing and marketing, and also to make it less easy to tamper with or damage. An exposed face 13 of housing 8 should be mounted flush with the appropriate portion of the door frame or door jamb. Normally, the exposed face 13 will be planar; however, it can have a curved shaped for some installations, such as a lock used to secure a round hatch.

The assembly 10 is mounted so as to cooperate with hinged or sliding door 9 mounted in the door opening. Alternatively, the subject locking assembly 10 could be installed inside door 9, although this is usually not the preferred condition. It is important to the present invention that operation of door 9 will control certain operations of the subject locking assembly.

Referring again to FIG. 1, the bolt 12 has a forward end portion 14 which, when the bolt is extended, cooperatively engages with a keeper 16 shown mounted on the door 9. The keeper 16 has a suitable opening large enough to receive the end portion 14 of the bolt when the bolt is moved to its locked position. The opposite rear-end portion of the bolt 12 has an end surface 18 which is shown at a suitable angle as will be explained.

The bolt 12 is slidably mounted in an inclined position in a groove or track 19 in a member 20. The member 20 has a bore 22 which contains a spring-biased ball 24 which is urged into an outwardly extended position, pressing it against bolt 12, by spring 26. The spring-biased ball 24 cooperates with two spaced indentations 28 and 30 formed in one side of bolt 12. The ball 24 engages the indentation 28 when the bolt is in its retracted or unlocked position, and it engages the indentation 30 when the bolt is in its extended or locked condition as shown in FIG. 1. The spring-biased ball 24 is provided to maintain the bolt in its two alternative locked and unlocked positions.

Various alternate embodiments of the spring-biased detente can be provided, such as a piece of spring metal with a rounded portion which presses against the bolt 12 and engages the indentations on the bolt. Alternately, a spring-mounted ball can be mounted on the bolt, and can engage indentations in member 20 which forms the track 19 that constrains bolt 12. In addition the indentation 30, which holds the bolt 12 in the extended position, can be omitted if desired, since the effect of gravity and/or the solenoid spring will normally hold the bolt in the extended position until the solenoid is energized.

Figure 6:
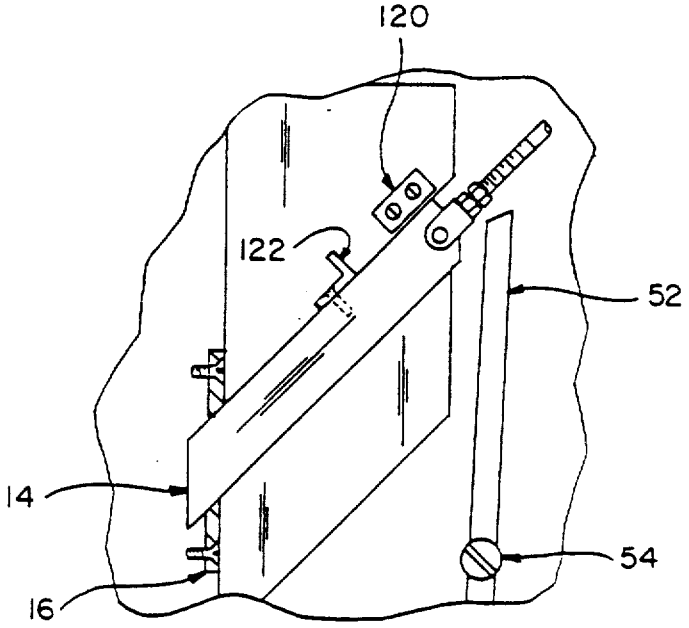
FIG. 6 is a fragmentary side-view showing a magnetic retaining device for the bolt.

In an alternate preferred embodiment, the means for holding the bolt in a retracted position can comprise a magnet 120 which cooperates with a ferromagnetic surface 122, such as shown in FIG. 6. For example, a horseshoe or bar magnet can be mounted in housing 8, so that it temporarily attaches to a steel plate that is mounted on the bolt 12, the rod assembly 32, or the solenoid armature 34 when the bolt is fully retracted.

Figure 5:
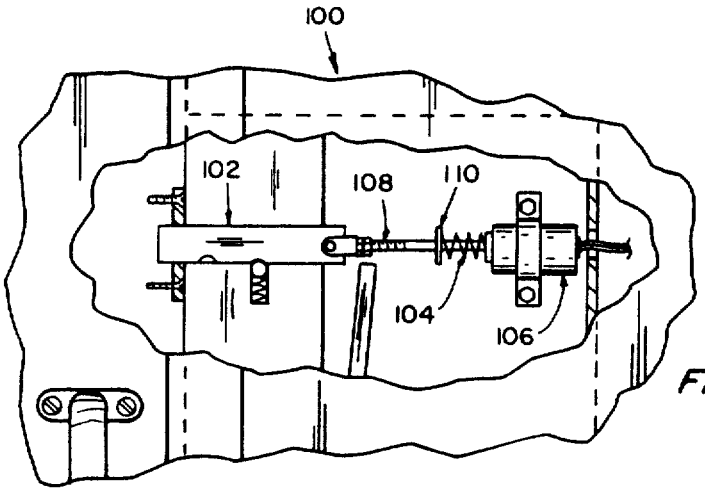
FIG. 5 is a fragmentary side elevated view showing an alternate version of the locking device employing a horizontally-mounted, spring-driven bolt.

Bolt 12 is connected by means of a rod assembly 32 to the armature 34 of a solenoid assembly 36. The solenoid assembly 36 is shown mounted in the housing structure 8, which holds the entire assembly 10, by means of a strap 40 and bolts or fasteners 42. The solenoid assembly 36 preferably has a compression spring, mounted externally as shown in FIG. 5 or internally within the solenoid, for urging the armature 34, the rod assembly 32, and the bolt 12 to the extended position. The rod assembly 32 may be connected to the bolt 12 by means of a pivot connection 44 to facilitate movement and to prevent binding therebetween.

Also mounted in the housing 8 with the bolt 12 and the solenoid assembly 36 is a substantially vertical lever arm 52 pivotally mounted at a midpoint by pivot means 54. The upper end 56 of lever arm 52 is positioned near the bolt rear-end surface 18. When bolt 12 is fully extended, a gap exists between end surface 18 and lever arm 52. This gap allows bolt 12 to retract sufficiently when solenoid 36 is actuated to disengage from keeper 16 in door 9, so the door 9 can be opened, without rotating lever arm 52. An alternate embodiment of this invention comprises a lever arm which is coupled to the bolt by means of a pin affixed to either the bolt or the lever arm, slidably mounted within an elongated slot in the other member.

Figure 3:
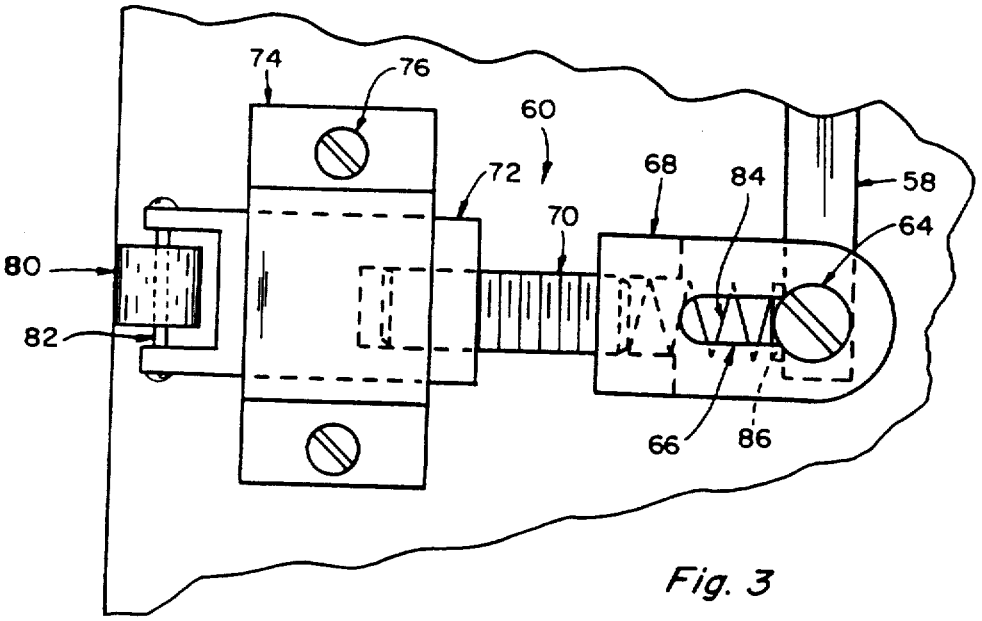
FIG. 3 is an enlarged view of a latch trigger assembly employed in a preferred embodiment of the present locking device.
Figure 4:
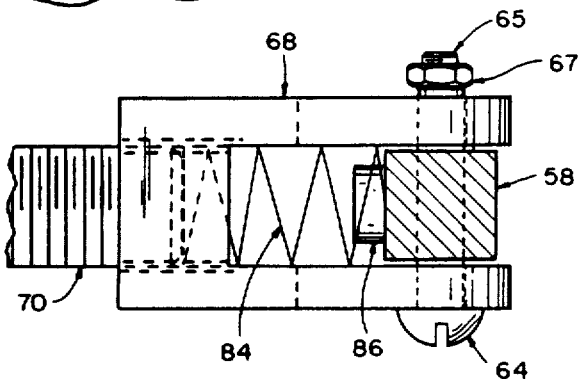
FIG. 4 is a plan view, looking down, of a portion of the latch trigger assembly.

The lower end 58 of the lever arm 52 is connected to a roller assembly 60, which is shown in one preferred embodiment in greater detail in FIG. 3 and FIG. 4. In this embodiment, lever arm end 58 is affixedly coupled to cross member 64, which can comprise a smooth-shafted bolt with a short threaded end 65 which is secured by nut 67. Cross member 64 is slidably positioned in a slot 66 in a yoke member 68. The yoke member 68 is threadedly connected to a rod 70 which has its opposite end fixedly connected to a member 72 which in turn is slideably mounted in a bracket 74, which is attached to the housing 8 by means of screws 76.

In the embodiment shown in FIG. 3, the exposed end of the member 72 is bifurcated and carries a roller member 80 which is rotatably mounted on a shaft 82. If desired, the roller 80 can be replaced by a different type of protruding device, such as a rounded or angled metallic piece which optionally can be covered or fronted by smooth hard plastic or any other desired material. Such protruding devices are commonly used in door locking mechanisms.

As shown in FIGS. 3 and 4, the yoke member 68 contains a spring 84. The right end of spring 84 is positioned against the lower end 58 of lever arm 52, and is held in position by rounded protusion 86. After insertion into the yoke member 68, the spring 84 is trapped within yoke member 68 by engaging the end of the rod 70, which rod end portion is threaded to cooperate with internal threads in the yoke member 68. An additional advantage of providing a threaded coupling between the rod 70 and (1) yoke member 68, and/or (2) member 72 is that the extension of roller 80 into the doorway can be adjusted while the bolt assembly is being installed in a doorway. This will allow the bolt assembly to accommodate variations in the clearances between door jambs and door edges, allowing each unit to be fine-tuned for smooth and durable performance in its particular location.

In one preferred embodiment, the spring 84 is relatively stiff and normally is not compressed during operation of the locking assembly. However, if bolt 12 is fully retracted when the roller member 80 is depressed, the spring 84 will be compressed to prevent stress or damage to the parts and especially to the lever arm 52. When solenoid 36 is energized by an electrical current, the rod assembly 32 and the bolt 12 are retracted far enough to cause bolt 12 to disengage and clear the keeper 16 in the door 9. During that retraction step, the bolt 12 closes the gap (shown in FIG. 1) between the bolt rear-end surface 18 and the upper end 56 of lever arm 52.

In an alternate preferred embodiment, there is no gap between the rear end 18 of bolt 12 and the upper end 56 of lever arm 52. The spring 84 is designed to be compressed when the bolt is retracted. It remains compressed until door 9 is opened, as described below.

While solenoid 36 remains energized, the bolt's rear-end surface 18 continues to exert force on lever arm 52, which transfers that force to the latch trigger assembly, which operates to press the roller 80 against the edge of the door 9. When the door 9 is opened, the roller 80 is able to move to an outwardly extended position (to the left), as shown in FIG. 2, and the bolt completes its retraction until spring-biased ball 24 engages the indentation 28 in the side of the bolt 12. The bolt remains retracted as long as the door remains open, held in place by engagement of the ball 24 in the indentation 28.

Thereafter, when the door is closed, it presses against the extended roller 80, forcing it to the right as shown and in turn moving the lower end 58 of the lever arm 52 to the right. The upper end of the arm 52 presses against the rear-end surface 18 of the bolt, forcing the bolt to move to the left within the track 19 in member 20, toward the locked position. In so doing, the motion of bolt 12 will cause the spring-biased ball 24 to disengage from the indentation 28. The bolt will the be able to move into the keeper 16 in door 9, aided in this movement by gravity, and if a spring is mounted on or incorporated within solenoid 36, by the additional force of the spring. The bolt will continue to move into the keeper 16 until it is in its extended locked position, in which position the ball 24 will engage the indentation 30 to maintain the bolt in its locked position.

FIG. 5 shows an alternative embodiment 100 of the subject locking device wherein a bolt 102 is shown in a horizontal rather than a sloping position. A spring 104 is mounted against the shoulder of solenoid assembly 106. When the solenoid is energized, rod assembly 108 is retracted, and a flange or collar 110 on the rod compresses spring 104. Except for this difference and the fact that gravity does not aid in locking the device as described above, the construction and operation of the device shown in FIG. 5 are similar to the angled-bolt assembly described above.

The arrangement of the locking device of this invention allows the lock to be opened by a guard or other operator at a remote and/or guarded position. The guard presses a button or otherwise closes an electrical circuit which sends electrical current to the solenoid 36. The door can be opened while the solenoid is energized. If desired, a door buzzer or other device can be positioned on either or both sides of the wall, allowing someone who wishes to pass through to alert the guard.

The operation of the door can be observed directly, or by means of a video camera. Alternately, it can be monitored by other means, such as by an electronic sensor. In settings such as prisons, remote-actuated doors are equipped with a monitoring system which indicates the status of every door at all times. For example, the indentations 28 on bolt 12 can be located such that the spring-mounted ball engages indentation 28 as soon as the edge 14 of the bolt 12 is retracted to a position that is flush with exposed face 13 of the housing 8; in that configuration, spring 84 on the latch trigger assembly would be compressed each time the bolt is retracted. A warning light in the control room would be activated as soon as the solenoid 36 is energized and the bolt 12 is retracted. That warning light would warn the security guard that the door is unlocked, regardless of whether the door is open or closed. The warning light would be turned off only when the door is closed and the bolt is extended into the bolt keeper on the door.

This invention is well-suited to the security needs of prisons, and to other high-security areas such as military bases, diplomatic installations, and corporate facilities. It also has the advantage that if someone tries to tamper with the lock while passing through the door, such as by pressing on the roller 80, the guard or other operator on duty merely has to reenergize the solenoid to retract the bolt. It is contemplated, also, to make the bolt assembly, including the housing and the components mounted in the housing, as a compact enclosed structure, for ease of mounting and to conceal the parts to discourage tampering. The fact that closing the door automatically latches the bolt is an especially important feature from the standpoint of security.

Thus there has been shown and described novel means for locking a door and particularly a door to a secure area such as in jails, doors to rooms where confidential information is stored, doors which are monitored by guards or other personnel, and doors where it is desirable to have the door self-locking simply by having the door closed. The present invention fulfills all the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only by the claims which follow.

What is claimed is:

1. A solenoid-operated door locking device having a first portion for mounting on a door jamb and a cooperating portion for mounting adjacent to the edge of a door comprising a door bolt keeper, and a door bolt assembly having a door bolt cooperatively engageable with the keeper to lock the door, said bolt assembly having a bolt positioned therein for movement between an extended locked position and a retracted unlocked position, a solenoid including a solenoid coil and an armature, the armature being operatively connected to the bolt and in substantially linear alignment therewith for moving the bolt from its extended position to a retracted position when the solenoid is energized, a latch trigger assembly extendable into the space between the door and the door jamb, and a lever assembly having one lever end operatively connected to the latch trigger assembly and a second lever end extending to adjacent the bolt, said lever assembly being movable when the latch trigger assembly is depressed when the door moves to its closed position, wherein the lever assembly, when so moved, applies force against the bolt in a direction to move the bolt toward its extended locked position, and means for retaining the bolt in the retracted unlocked position until said bolt is moved toward the extended locked position by the lever assembly.

2. The solenoid-operated door locking device of claim 1 wherein the bolt is mounted at an acute angle relative to the horizontal.

3. The solenoid-operated door locking device of claim 1 wherein the means for retaining the bolt in the retracted position includes a spring-biased protruding member mounted within the door bolt assembly which engages an indentation formed in a surface on the bolt.

4. The solenoid-operated door locking device of claim 1 including means formed on the bolt for cooperating with means mounted within the door bolt assembly to retain the bolt in its extended locked position.

5. The solenoid-operated door locking device of claim 1 wherein the end of the latch trigger assembly which extends into the spaced between the door and the door jamb has a roller formed thereon.

6. The solenoid-operated door locking device of claim 1 wherein the latch trigger assembly is provided with adjusting means for varying the extension of the latch trigger assembly into a doorway.

7. The solenoid-operated door locking device of claim 1 wherein the bolt assembly is contained within a housing structure capable of being installed as a single unit.

8. The solenoid-operated door locking device of claim 1 wherein the means for retaining the bolt in a retracted position comprises a magnet which cooperates with a cooperating steel member, wherein either said magnet or said cooperating steel member are affixedly connected to said bolt and move in conjunction with said bolt.

9. The solenoid-operated locking device of claim 1 wherein the track and the bolt movably positioned therein are horizontal.

10. A solenoid-operated door bolt assembly, comprising a track having a bolt positioned therein for movement between an extended locked position and a retracted unlocked position, a solenoid including a solenoid coil and an armature wherein the armature is operatively connected to the bolt in substantially linear alignment therewith for moving the bolt along the track from its extended position to a retracted position when the solenoid is energized, and a lever assembly having a latch trigger portion extendable into the space between a door and a door jamb and a second angularly related portion extendable to a position for engagement with the bolt, said lever assembly being movable to a retracted position where, when a cooperating door moves to a closed position, the latch trigger portion is depressed and the lever assembly applies force against the bolt in a direction to move the bolt toward its locked position.

11. The solenoid-operated door locking device of claim 10 wherein the bolt and the track are mounted at an acute angle relative to the horizontal.

12. The solenoid-operated locking device of claim 10 including means formed on the bolt for cooperating with means mounted on the track to retain the bolt in its retracted unlocked position.

13. The solenoid-operated door locking device of claim 12 comprising a spring-biased protruding member mounted adjacent to the track, and an indentation formed in a surface on the bolt for engagement by the protruding member.

14. The solenoid-operated door locking device of claim 10 wherein the latch trigger assembly is provided with adjusting means for varying the extension of the latch trigger assembly into a doorway.

15. The solenoid-operated door locking device of claim 10 wherein the bolt assembly is contained within a housing structure capable of being installed as a single unit.

16. The solenoid-operated door locking device of claim 10 wherein the retaining means for holding the bolt in a retracted position comprises a magnet which cooperates with a steel surface.

17. An electromechanical locking device, comprising:

a. a housing designed to be mounted in a wall adjacent to a door opening, having an exposed face through which a bolt passes;

b. a bolt which is slidably mounted within the housing, having a travel path such that one end of the bolt (1) extends beyond the exposed face of the housing when the bolt is in an extended position and (2) does not extend beyond the exposed face of the housing when the bolt is in a retracted position;

c. a solenoid including a solenoid coil and an armature wherein the armature is operatively connected in a substantially linear manner to the bolt in a manner such that the bolt is pulled toward the retracted position when electrical current is supplied to the solenoid;

d. a lever mounted on a pivot and positioned so that one end of the lever is forced to move by the bolt when the bolt is moved to a fully retracted position by the solenoid;

e. a latch trigger coupled to the lever in a manner such that (1) one end of the latch trigger is extended into the door opening when the bolt is moved to a fully retracted position, and (2) the lever is pressed against the bolt, urging the bolt towards the extended position, when the latch trigger is depressed;

f. retaining means for holding the bolt in a retracted position after it is retracted by the solenoid, until the action of depressing the latch trigger causes the bolt to disengage from the retaining means.

18. The solenoid-operated door locking device of claim 17 wherein the bolt and the track are mounted at an acute angle relative to the horizontal.

19. The solenoid-operated locking device of claim 17 wherein the retaining means for holding the bolt in a retracted position comprises a spring-biased protruding member mounted within the housing so that it engages an indentation formed in a surface on the bolt.

20. The solenoid-operated door locking device of claim 17 wherein the retaining means for holding the bolt in a retracted position comprises a magnet which cooperates with a steel surface.

21. The solenoid-operated locking device of claim 17 wherein the track and the bolt movably positioned therein are horizontal.

22. The solenoid-operated door locking device of claim 17 wherein the latch trigger portion of the lever assembly is provided with adjusting means for varying the extension of the latch trigger portion into a doorway.

23. The solenoid-operated door locking device of claim 17 wherein the bolt assembly is contained within a housing structure capable of being installed as a single unit.

* * * * *

UNITED STATES PATENT AND TRADEMARK OFFICE

CERTIFICATE OF CORRECTION

PATENT NO. : 4,993,757

DATED : February 19, 1991

INVENTOR(S) : Robert D. Corezine

It is certified that error appears in the above-identified patent and that said Letters Patent is hereby corrected as shown below:

Column 6, line 9, after "will" delete "the"

Column 7, line 61, delete "spaced" and insert --space--.

Signed and Sealed this

Thirtieth Day of June, 1992

*Attest:*

DOUGLAS B. COMER

*Attesting Officer*

*Acting Commissioner of Patents and Trademarks*